United States Patent [19]

Hall et al.

[11] 4,121,390

[45] Oct. 24, 1978

[54] PRE-CAST UNITS FOR SEWER CONSTRUCTION

[75] Inventors: Alfred George Hall, London; Brian E. Brown, Burlington, both of Canada

[73] Assignee: Moduloc Concrete Products (London) Ltd., Concord, Canada

[21] Appl. No.: 801,439

[22] Filed: May 27, 1977

[51] Int. Cl.[2] ..... E02D 29/12

[52] U.S. Cl. ..... 52/20; 52/125; 404/26

[58] Field of Search ..... 52/20, 21, 125, 124, 52/603, 606, 605, 693; 404/25, 26; 98/31, 58; 206/509, 512

[56] References Cited

U.S. PATENT DOCUMENTS

| | | | |
|---|---|---|---|
| Re. 17,020 | 7/1928 | Healy | 52/529 |
| 746,628 | 12/1903 | Field | 52/606 |
| 945,597 | 1/1970 | Prendergast | 52/20 |
| 1,565,681 | 12/1925 | Sonderby | 52/125 |
| 2,577,170 | 12/1951 | Walters | 52/606 |
| 2,968,130 | 1/1961 | Bascom | 52/20 |

FOREIGN PATENT DOCUMENTS

| | | | |
|---|---|---|---|
| 317,055 | 12/1919 | Fed. Rep. of Germany | 52/20 |
| 818,791 | 8/1959 | United Kingdom | 52/21 |

*Primary Examiner*—Price C. Faw, Jr.
*Assistant Examiner*—Henry Raduazo
*Attorney, Agent, or Firm*—Ladas, Parry, Von Gehr, Goldsmith & Deschamps

[57] ABSTRACT

A manhole or a catch basin is built up by stacking a number of pre-cast concrete units. The joints between the units are provided, prior to stacking, with a bead of a non-hardening, semi-liquid, mastic waterproof layer to enable subsequent removal of the units without damaging same. The pre-cast concrete unit of this invention is typical by having cutouts in the side wall and corresponding protrusions extending from one face thereof. Hand or tool receiving depressions are provided in one surface of the unit to facilitate the handling of the unit when increasing or reducing the overall height of a manhole. The shape of the unit not only facilitates the production of same but also assists in convenient handling. Due to generally smooth faces, the steaming-off of the waterproof layer prior to the storage of a removed unit is also facilitated.

13 Claims, 8 Drawing Figures

PRE-CAST UNITS FOR SEWER CONSTRUCTION

The present invention relates to a method for stacking pre-cast concrete units to produce a manhole or a catch basin and to a pre-cast concrete unit suitable for use in such method.

It is known to produce manholes of considerable height from a plurality of relatively low, annular or rectangular units which are stacked one on the other. The units used in the art comprise matching grooves and tongues or similar means for preventing undesired displacement of stacked units and to assure appropriate alignment of the units when building up the manhole.

In most cases it is desirable that manhole walls be substantially water tight and the joints of the manhole units pose problems in this respect. In general, the water tightness of such joints is accomplished by joining the units by concrete or by similar mixture which hardens and thus makes the combination of the units one solid rigid body. If the pavement or the like is to be raised or lowered on subsequent occasions, the disassembling of the manhole of the above type is difficult and normally results in destruction of the pre-cast units and thus in waste and in increased costs. Attempts have been made to solve this problem by applying joint sealing elements produced from rubber-like material such as those disclosed in Canadian Pat. No. 950,727 issued July 9, 1974, Canadian Pat. No. 950,726 issued July 9, 1974 or in Canadian Pat. No. 784,449 issued on May 9, 1968. Such sealing elements enable the disassembling of the stacked units but, at the same time, present an additional item to be stored in the form of spares and, in most cases, the sealing elements cannot be used to entirely enclose an annular joint unless a special size is prepared in advance. Moreover, the sealing members change their mechanical properties which are vital for appropriate sealing effect, depending on temperature, aging or the like.

It is an object of the present invention to provide a method of building manholes or the like, which would possess the advantages of both of the aforesaid known methods and which would be free of the drawbacks thereof. Another object of the present invention is to provide a pre-cast concrete unit of a relatively simple shape suitable for the production of the units, useful for application in the method of the present invention and facilitating, to a substantial degree, the handling of same, particularly when reducing the height of a manhole.

According to the present invention, a pre-cast concrete unit is provided for building a manhole by stacking a plurality of pre-cast concrete units. The unit comprises a peripheral member defined by a first, generally flat face and by a second, generally flat face, said faces being generally parallel with each other and spaced from each other and having each an inside edge portion and an outside edge portion. The peripheral member is further defined by an inside wall and an outside wall extending between said inside edge portions and said outside edge portions, respectively. The unit further includes locking means for maintaining a stack of same in an aligned relationship. The locking means comprises male members and female members peripherally spaced from each other. The females members are a plurality of peripherally spaced cutouts provided in one of said walls, the depth of each of the cutouts being less than the width of the peripheral member. The male members are a plurality of protrusions corresponding to said cutouts and protruding from at least one of said faces, said male members being peripherally spaced from said cutouts. Thus, the unit according to the present invention has generally flat faces which are continuous about the entire periphery of the unit and which are thus relatively simple to produce and easy to clean.

These and other features of the present invention will become apparent from the following disclosure of two embodiments of same, with reference to the accompanying drawings, in which.

Figure 1:
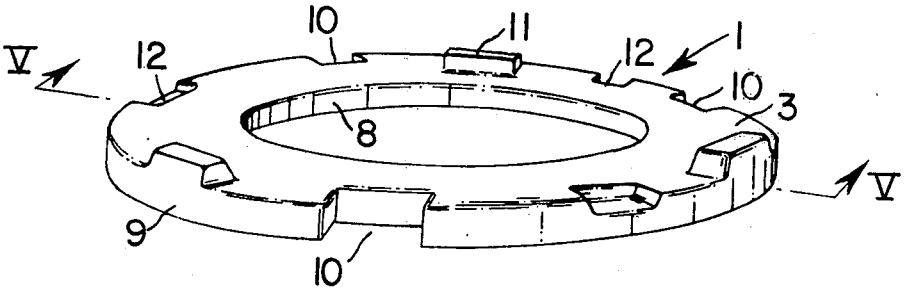
FIG. 1 is a top perspective view of one embodiment of the pre-cast concrete unit according to the present invention.
Figure 2:
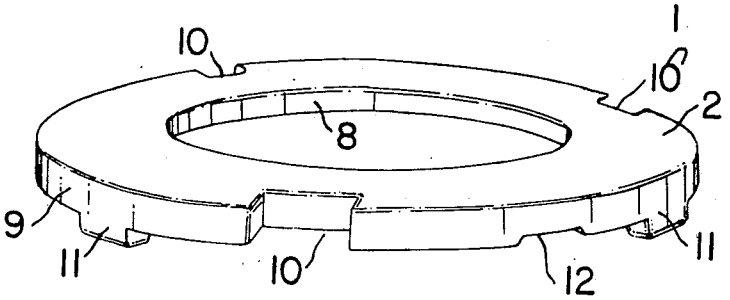
FIG. 2 is a perspective bottom view of the unit of FIG. 1.

Turning firstly to FIGS. 1 and 2, a pre-cast concrete unit 1 is shown for building a manhole by stacking a plurality of the units 1. The unit 1 is comprised of a peripheral member which is defined by a top face 2, also referred to as a first face, and by a bottom face 3, also referred to as a second face. Both faces 2, 3 are generally flat and generally parallel with each other. The faces 2 and 3 are spaced from each other and have each an inside edge portion 4, 5, and an outside edge portion 6, 7. The peripheral member is further defined by an inside wall 8 and by an outside wall 9, the walls extending between the respective inside edge portions 4, 5 and the respective outside edge portions 6, 7. The embodiment shown in FIGS. 1 and 2 further comprises locking means for maintaining a stack of the units 1 in an aligned relationship. The locking means comprises male members and female members which will now be described in greater detail.

The female members are three peripherally spaced, generally rectangular cutouts 10 provided in the outside wall 9 and spaced from each other at approximately 120°. In other words, three cutouts 10 are provided which are equidistantly spaced from each other with respect to the periphery of the unit 1. The depth of each of the cutouts 10 as measured radially of the unit 1 is less than the width of the peripheral member, which is determined by the radial distance between the outside wall and the radially adjacent portion of the inside wall.

The male members are of the type of generally rectangular protrusions 11, the shape of the protrusions being such that each protrusion 11 can be received in one of the cutouts 10. The peripheral spacing of the protrusions 11 is the same as that of the cutouts 10 to secure simultaneous insertion of the protrusions 11 in respective cutouts of the adjacent unit in a stack, located immediately below the unit 1. The protrusions 11 are, of course, also located in proximity to the outside wall 9. It will thus be seen that the top face 2 of the unit 1 is generally flat and free of any obstructions, which is of advantage particularly from the standpoint of cleaning of the face 2 subsequent to removal of the unit 1 from a previously assembled manhole. It will also be appreciated that the cleaning of the bottom face 3 of the unit is also facilitated because the flat surface of the bottom face is generally continuous around the whole unit, except for relatively limited areas of the protrusions 11.

In the preferred embodiment, each of the cutouts 10 is spaced from its respective protrusion 11 by 60°.

Figure 7:
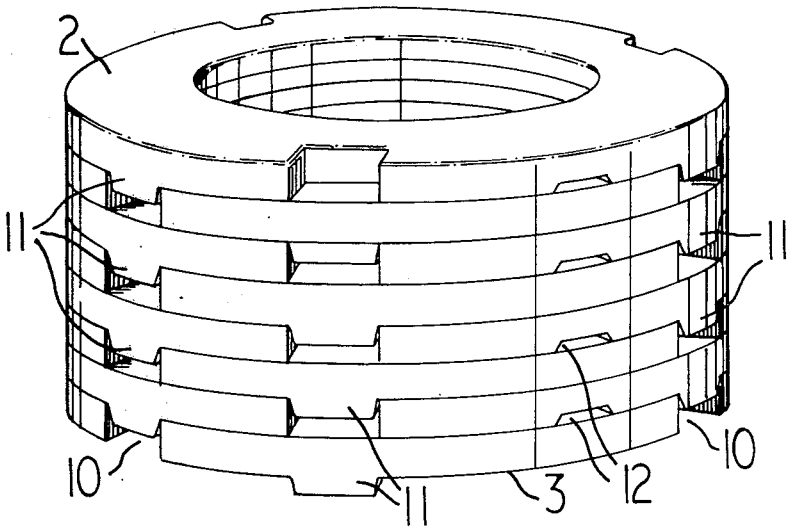
FIG. 7 is a partial perspective view similar to that of FIG. 6 but showing the use of units as shown in FIGS. 1 and 2.
Figure 8:
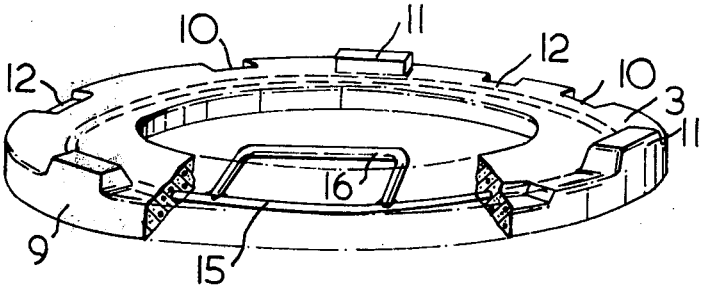
FIG. 8 is a perspective view, partly broken away, similar to FIG. 1, showing a still further embodiment of a unit according to the invention.

As best seen from FIG. 7, the height of the protrusions 11 is less than the entire thickness of the unit 1, while the cutouts 10 preferably extend the entire thickness of the unit, to facilitate the production thereof. The depressions 12 are each limited in height and in depth so as to provide a recess which is open from the outside wall and from the bottom face but closed otherwise, to secure watertight fit between two adjacent units 1. The depressions 12 substantially facilitate the handling of the unit 1 as they allow for inserting of a tool such as a pry-bar to separate the stacked units. When assembling a manhole, the depressions 12 are useful in that they allow for holding of each of the units by the workers while lowering the unit onto a stack.

When assembling a manhole, each of the units 1 is provided on its faces 2, 3 with a sealant to be disclosed hereinafter and then stacked on one another. The spacing of the handholes or depressions 12 is also 120° with each depression 12 being located at an approximately 30° peripheral spacing from the adjacent protrusion 11 and cutout 10.

Any of the units 1 can be provided with a casting step rod (not shown) protruding from the inside wall 8 in a known manner.

Figure 3:
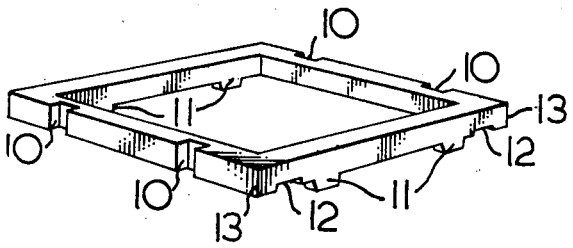
FIG. 3 is a perspective top view of another embodiment of the pre-cast concrete unit according to the present invention.
Figure 4:
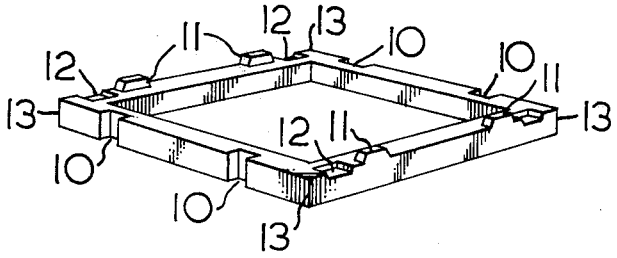
FIG. 4 is a perspective bottom view of the embodiment of FIG. 3.
Figure 5:
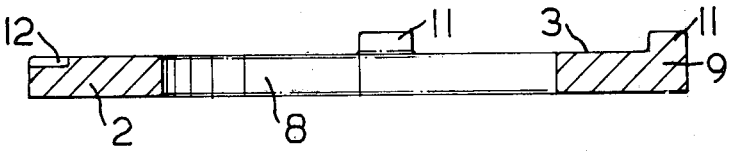
FIG. 5 is a section of two adjacent units as shown in FIG. 1 and as assembled in a manhole structure, the section of the top unit shown in FIG. 5 being section V—V of FIG. 1.

The embodiment shown in FIGS. 2 and 3 utilizes the same basic features of the present invention as that of FIGS. 1 and 2. The corresponding parts of same are therefore referred to with the same reference numerals. It will be appreciated, however, that the mutual peripheral spacing of the cutouts 10, protrusions 11 and depressions 12 has been changed to render same useful for a generally square-shaped unit 1. The depressions 12 of the units in FIGS. 3 and 4 are located near the outside corners 13 of the square-shaped unit 1.

FIG. 7 shows another embodiment of the unit of FIGS. 1 and 2, which is provided with a peripheral reinforcement rod 15 of steel. Fixedly secured to the rod 15 by soldering or by welding is a rectangular step 16 also made of suitably shaped steel rod of a diameter slightly greater than that of the rod 15. The rod 15 and the step 16 thus form a unitary structure which is embedded in the unit 1. The shown embodiment is produced by first manufacturing the rod-and-step unit 15, 16, then placing such unit into a mold and finally pouring concrete into the mold. The final step unit is superior to the known step units in that the step is more firmly and thus more safely secured to the concrete unit, as compared to the known step units. The step is not subject to loosening due to the environmental attack on step securing mortar or the like used in the known units, as it forms a substantially unitary part of the overall unit 1.

Figure 6:
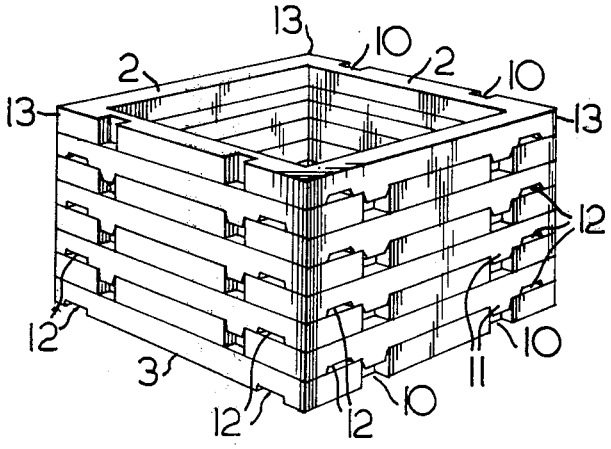
FIG. 6 is a partial perspective view of a stack of units as arranged when building a manhole, the units being of the type shown in FIGS. 3 and 4.

In carrying out the method of the present invention, the above described units were stacked one upon the other to provide the structure as shown in FIG. 6 or 7, the lowermost unit resting on a suitable base (not shown in the drawings). Obviously, such base has to have a top surface corresponding in shape and in size to that of the top face 2 so as to interlock with the bottom face of the lowermost unit. In order to provide a suitable base member, a special unit is provided similar to the units as described above but not having the protrusions 11. Such base unit, which is generally flat on both faces, is positioned on the existing, conventional sewage pipe or the like and bonded to same either by the present method or by any suitable method known from prior art, to form a base or lowermost unit of a stack. The top face of such unit is then provided with a continuous bead of a non hardening, semi-liquid, mastic waterproof mixture 14, the properties of which meet the following requirements:

Tensile Strength: 200–300 psi
Tensile Elongation: 500–800%
Tensile Strength: 100% Elongation (100% modulus) 40–60 psi
Recovery 90–95%
Adhesion to Concrete: 15–25 pli
Water Absorption: 1 week — 2.0–2.6% 4 weeks — 2.8–3.5% 6 weeks — 3.0–3.8%
Low Temperature Brittleness: Elongation at −20° F.: 200–300%
Heat Aging: Tensile strength and elongation both increased 25–50% after 36 hrs. 180° F. (83° C.)
Specific Gravity: 8.2–8.5 lb./Gal.
Percent Solids: 88%
Viscosity: 5000–8000 cps at 200 RPM
Shelf Life: Minimum 6 months
Curing Time: (50% R.H., 75° F.) Overnight to rubbery film
Solid content approximately 90%.
Cure time
at 70° F. — 24 hours
at 32° F. — 60 hours
at 25° F. — Heavy skin after 72 hours
Cure under water — 26 hours at 70° F.
Cure under protection board — 30 hours to rubbery set at 70° F.
Adhesion: Concrete — Good.

It has been found that one of the mixtures meeting these conditions has the following general composition:

Asphalt — 40 to 45%
Xylene — 10 to 15%
Poly-glycol-ether — 35 to 40%
Polyol — 5 to 10%
Benzoyl Chloride — 0.1 to 1%

One of the examples of the above substance is "Tremproof T.P. 62" (registered Trade Mark), used in waterproofing roofs.

The bead is about ½ inch in diameter and spaced about two inches from the inside wall of the base unit, i.e. about six inches from the outside wall. The first unit 1 of the present invention is then placed on top of the base unit spreading by its weight the mixture 14, with the protrusions 11 engaging the cutouts of the base unit. The top face 2 of the unit 1 is then provided with a bead of the mixture 14 as described above and a further unit 1 is placed onto the first with the protrusions 11 of the latter unit engaging the cutouts 10 of the former. The procedure continues until the desired height of the manhole or catch basin (rectangular unit) is achieved.

On application, the material remains in semiliquid state through extreme temperature changes and thaw cycles. When the pavement level is to be lowered or raised on subsequent occasions, the top units may be replaced, added or deleted, with no waste. Excess units can be steamed clean and stored for re-use thus avoiding destruction of brick work and mortar which causes a great deal of waste and cost to municipalities.

Those skilled in the art will readily appreciate many modifications of the present invention. For instance, the above bonding substance is to be considered as a preferred embodiment only. Other substances having similar characteristics can be provided without departing from the scope of the present invention. The protrusions 11 and the cutouts 10 of the units may be disposed in a different manner, for instance at the inside wall 8 or both at the inside wall 8 and the outside wall 9, even though the shown arrangement is preferable as it provides for a smooth inside opening of the manhole. The actual shape of the cutouts and of the cutouts 10 and protrusions 11 need not necessarily be of a rectangular plan as shown, even though the shown shape is deemed preferable. Similarly, the actual number of the locking cutouts and protrusions may differ from that shown, it being understood that, at least in theory, two cutouts and protrusions located at remote extremities from each other would also provide the effect of the present invention.

These and many other modifications of the preferred embodiment as disclosed hereinbefore, however, do not depart from the scope of the present invention as defined in the accompanying claims.

The embodiments of the invention in which an exclusive property or privilege is claimed are defined as follows:

1. A pre-cast concrete unit for building a manhole by stacking a plurality of generally identical units on each other in an upwardly coaxial fashion; said unit comprising a peripheral member defined by a first generally flat face and a second generally flat face, the faces being each generally coincident with a single plane, said faces being generally parallel with each other and axially spaced from each other and having each an inside edge portion and an outside edge portion; an inside wall and an outside wall extending between said inside edge portions and said outside edge portions, respectively, to define the width of said member; and locking means for maintaining a stack of said units in a vertically coaxially aligned relationship; said locking means comprising male members peripherally spaced from each other, and female members peripherally spaced from each other and from said male members; said female members being a plurality of peripherally spaced cutouts provided in at least one of said walls, the depth of each of said cutouts being less than the width of said peripheral member; said male members being a plurality of protrusions corresponding in peripheral shape to the contour of said cutouts and protruding from at least one of said faces near said at least one of the side walls; whereby each of said faces of the peripheral member is a generally flat planar surface, continuous over generally the entire width of said member.

2. A unit as claimed in claim 1 wherein said cutouts extend the entire thickness of said peripheral member as measured from said first face to said second face, the height of said male members, as measured perpendicularly to said at least one of said surfaces, being less than the overall thickness of said peripheral member as measured between said generally flat surfaces.

3. A unit as claimed in claim 1 wherein said cutouts are provided in said outside wall only, and wherein said male members protrude from said first face only, whereby the surface of said second face is generally free of any projections, said cutouts extending the entire thickness of said peripheral member as measured between said generally flat surfaces.

4. A unit as claimed in claim 1, further comprising a plurality of depressions peripherally spaced from each other and provided in at least one face of said unit, said depressions being open only at said outside wall and at said at least one face and being peripherally spaced from said cutouts and from said protrusions.

5. A unit as claimed in claim 4 wherein said depressions are only in one face of said peripheral member, said male members also protruding only from said one face.

6. A unit as claimed in claim 5 wherein said peripheral member is of a generally square plan, said depressions being located near the outside corners of said peripheral member.

7. A unit as claimed in claim 1 wherein said peripheral member is of a generally annular shape, said cutouts being peripherally spaced from each other at approximately 120°, said male members also being peripherally spaced from each other at approximately 120°.

8. A unit as claimed in claim 1 wherein said peripheral member is of a generally annular shape, said cutouts being peripherally spaced from each other at approximately 120°, said male members also being peripherally spaced from each other at approximately 120°; each of said male members being peripherally spaced from the adjacent cutouts at approximately 60°.

9. A unit as claimed in claim 4 wherein said peripheral member is of a generally annular shape, said cutouts being peripherally spaced from each other at approximately 120°, said male members also being peripherally spaced from each other at approximately 120°; each of said male members being peripherally spaced from the adjacent cutouts at approximately 60°; said depressions being peripherally spaced from each other at about 120°, each of said depressions being peripherally spaced by about 30° from the respective adjacent male member.

10. A unit as claimed in claim 1, which is of a generally annular shape and which includes a peripheral reinforcement member embedded in said unit, and a step unit protruding from said inside wall, said step unit being unitary with said reinforcement member.

11. A unit as claimed in claim 1, further comprising a plurality of depressions peripherally spaced from each other and provided in at least one face of said unit, said depressions being open only at said outside wall and at said at least one face and being peripherally spaced from said cutouts.

12. A unit as claimed in claim 11 wherein said depressions are only in one face of said peripheral member.

13. A unit as claimed in claim 11, wherein said peripheral member is of a generally square plan, said depressions being located near the outside corners of said peripheral member.

* * * * *